US009682545B2

(12) United States Patent
Izume

(10) Patent No.: US 9,682,545 B2
(45) Date of Patent: Jun. 20, 2017

(54) PRINTING APPARATUS

(71) Applicant: I. MER CO., LTD., Kyoto-shi (JP)

(72) Inventor: Masayuki Izume, Kyoto (JP)

(73) Assignee: I. MER CO., LTD., Kyoto-Shi (JP)

( * ) Notice: Subject to any disclaimer, the term of this patent is extended or adjusted under 35 U.S.C. 154(b) by 0 days.

(21) Appl. No.: 14/576,204

(22) Filed: Dec. 19, 2014

(65) Prior Publication Data

US 2015/0174892 A1 Jun. 25, 2015

(30) Foreign Application Priority Data

Dec. 25, 2013 (JP) ..... 2013-266212

(51) Int. Cl.

| | |
|---|---|
| ***B41F 17/22*** | (2006.01) |
| ***B41F 31/02*** | (2006.01) |
| ***B41F 31/30*** | (2006.01) |
| ***B41F 31/22*** | (2006.01) |

(52) U.S. Cl.

CPC ..... *B41F 31/22* (2013.01); *B41F 17/22* (2013.01); *B41F 31/02* (2013.01); *B41F 31/302* (2013.01)

(58) Field of Classification Search

CPC ..... B41F 17/22; B41F 31/302; B41F 31/02; B41F 35/04

See application file for complete search history.

(56) References Cited

U.S. PATENT DOCUMENTS

| | | | | |
|---|---|---|---|---|
| 2,206,712 | A * | 7/1940 | Babson | B41F 31/06 101/351.1 |
| 5,010,813 | A * | 4/1991 | Buffo | B41F 5/24 101/178 |
| 5,207,160 | A * | 5/1993 | Harada | B41F 35/06 101/423 |
| 5,953,994 | A * | 9/1999 | Seefried | B08B 1/007 101/424 |
| 7,373,880 | B2 * | 5/2008 | Niemiro | B41F 31/302 101/180 |
| 2008/0134916 | A1 * | 6/2008 | Luckhardt | B41F 31/26 101/425 |
| 2012/0272846 | A1 * | 11/2012 | Fleischer | B41F 17/22 101/38.1 |

FOREIGN PATENT DOCUMENTS

| | | |
|---|---|---|
| JP | 2009-226787 | 10/2009 |

* cited by examiner

*Primary Examiner* — Jill Culler
*Assistant Examiner* — Leo T Hinze
(74) *Attorney, Agent, or Firm* — Mori & Ward, LLP

(57) ABSTRACT

An ink supply unit is a unitized member having a casing accommodating components therein. A plurality of plate cylinders are arranged in a circumferential direction at predetermined intervals. The ink supply unit corresponding to the plate cylinder is disposed on a radially outer side of the plate cylinder. The ink supply unit can move between an operation position in which ink can be supplied to the plate cylinder and a standby position located further to a radially outer side than the operation position.

7 Claims, 4 Drawing Sheets

PRINTING APPARATUS

BACKGROUND OF THE INVENTION

Field of the Invention

The present invention relates to a printing apparatus and, particularly, relates to a printing apparatus suitable for performing printing on, for example, a can.

Background Art

A printing apparatus including a plurality of plate cylinders for printing different colors, a plurality of ink supply units for supplying ink to the respective plate cylinders, and a machine frame for supporting both the plurality of plate cylinders and the plurality of ink supply units has been known as a printing apparatus for a can (see JP-A-2009-226787).

In the printing apparatus described above, an increase in the number of plate cylinders is necessary for more precise printing. However, it is necessary to prevent an increase in the size of the printing apparatus, resulting from an increase in the number of plate cylinders. As a result, it is extremely difficult to increase the number of plate cylinders without increasing the size of the printing apparatus. Furthermore, it is difficult to automatically perform an operation of mounting a plate on the plate cylinder. Accordingly, the operation is manually performed but requires automation.

An object of the invention is to solve the problem described above and provide a printing apparatus in which an increase in the number of plate cylinders can be achieved without an increase in size of the printing apparatus and in which it is easy to automate an operation for mounting a plate.

SUMMARY OF THE INVENTION

According to an aspect of the invention, there is provided a printing apparatus including a plurality of plate cylinders for printing different colors, a plurality of ink supply units which respectively supply ink to the plate cylinders, and a machine frame which supports the plurality of plate cylinders and the plurality of ink supply units. In the printing apparatus, the ink supply unit is a unitized member having a casing accommodating components therein and the plurality of plate cylinders are arranged in a circumferential direction at predetermined intervals. Furthermore, the ink supply unit corresponding to the plate cylinder is disposed on a radially outer side of the plate cylinder and the ink supply unit can move between an operation position in which ink can be supplied to the plate cylinder and a standby position located further to a radially outer side than the operation position.

The ink supply unit includes, as components, an ink fountain roller, an ink feeding roller, an ink ducting roller, a plurality of ink distributing rollers, one ink applying roller or more, an ink container, an ink scraping device, and the like. Ink supplied from the ink container is supplied to a portion between the ink fountain roller and the ink feeding roller. Subsequently, the ink ducting roller adjusts the amount of ink and the ink passes through the plurality of ink distributing rollers. Then, the ink is supplied to a plate provided in the plate cylinder.

In a printing process, printing is performed in such a manner that the respective ink supply units are located at the operation positions, and thus the ink is supplied to the plate cylinders. In a printing apparatus of the related art, respective ink supply units are fixed at operation positions, and thus the ink supply units cannot move. However, in the case of the printing apparatus of the invention, when printing is not performed, the respective ink supply units are moved to the standby positions located further to the radially outer side of the printing apparatus than the operation positions. Accordingly, gaps can be provided in both the periphery of the plate cylinder and the portion between the adjacent ink supply units. Plate replacement or maintenance of the plate cylinder or each ink supply unit can be performed through the gaps. Furthermore, a large space is ensured in the periphery of the plate cylinder, and thus it is easy to perform plate replacement using a robot.

When the respective ink supply units are located at the operation positions, it is not necessary to provide gaps for performing plate replacement or maintenance of the plate cylinder or each ink supply unit. Thus, in this case, a significantly small gap is provided in the portion between the adjacent ink supply units. As a result, an increased number of both the plate cylinders and the ink supply units can be arranged.

In the aspect, the printing apparatus may further include an ink supply unit moving device which moves the ink supply unit between the operation position and the standby position. In addition, the ink supply unit moving device may include a pair of slide rails, a slider which is disposed on the pair of slide rails in a state where the slider can move in the radial direction and is mounted on the casing of the ink supply unit, and a driving device which is mounted on a machine frame and moves the slider in a radial direction.

In this case, the ink supply unit can be appropriately moved to a required position, as needed. The driving device may be a linear feeding device using a ball screw.

In the aspect, the printing apparatus may further include a dust collector. In addition, the dust collector may include a plurality of intermediate sealing members, each of which seals a space between the adjacent ink supply units in the operation positions, end-portion sealing members which seal spaces on circumferential outer-sides of the ink supply units in both circumferential ends, and sucking means which is connected to at least one of the plurality of intermediate sealing members and the end-portion sealing members and sucks up mist in an internal space.

Preventing scattering of mist is extremely difficult in a printing apparatus of the related art. However, scattering of mist is prevented in the printing apparatus of the invention, in such a manner that an internal space is sealed using both the intermediate sealing member and the end-portion sealing member for sealing. Sucking means has, for example, a suction tube provided for each sealing member and a pump for vacuating the suction tube. The suction tubes may not be provided in all of the sealing members and may be provided in some of the sealing members.

In the aspect, ink scraping devices for cleaning may be respectively provided in the ink supply units. In addition, a plurality of rollers constituting the ink supply unit may be symmetrically arranged with respect to a central line extending in the radial direction, except for an ink fountain roller. Furthermore, the ink scraping devices for cleaning may include the ink scraping device for cleaning disposed on a clockwise side of the ink supply unit and the ink scraping device for cleaning disposed on a counter-clockwise side.

To collect the scraped remaining ink during cleaning performed after printing, it is necessary to arrange the ink scraping device for cleaning, in a horizontal direction. However, when the number of ink supply units is increased, it is difficult to ensure a space for arranging the ink scraping device for cleaning. In the printing apparatus of the invention, the plurality of rollers constituting the ink supply unit are symmetrically arranged, and thus the ink scraping devices for cleaning can be disposed to either the clockwise sides or counter-clockwise sides of the ink supply units. Accordingly, the arrangement positions of the ink scraping devices for cleaning can be distributed to the clockwise sides and the counter-clockwise sides, in accordance with the arrangement positions of the ink supply units arranged in the circumferential direction. As a result, it is possible to ensure a space for arranging the ink scraping device for cleaning.

The ink fountain roller may be symmetrically disposed or may be asymmetrically disposed. It is preferable that the ink fountain roller be asymmetrically disposed in accordance with the arrangement position of the ink container. In the case of the arrangement positions of the ink containers, the ink containers may be respectively arranged on the radially outermost sides of the ink supply units. Alternatively, the arrangement positions of the ink containers may be changed in accordance with the arrangement positions of the ink supply units.

In the aspect, the printing apparatus of the invention may be suitable as a printing apparatus for a can which performs printing on a can supplied by a can feeding device. In addition, the printing apparatus may include a plurality of motors for driving a blanket cylinder, the plate cylinder, and the rollers of the ink supply unit and a motor control device. Furthermore, the motor control device may have speed detecting means for detecting the feeding speed of the can feeding device and controls the respective motors to be matched with the can feeding speed of the can feeding device.

In a printing apparatus for a can of the related art, movement of the components is matched with the rotation of the can feeding device, in such a manner that the components are connected, using a gear train, to the can feeding device. As a result, there is a problem in that heat generation is high and control accuracy relating to rotation is reduced in the printing apparatus. However, in the printing apparatus of the invention, respective rotating members are driven by motors and speed detecting means is provided, as a control device on the printing apparatus side, to detect the feeding speed of the can feeding device. As a result, the problem in the printing apparatus of the related art is solved in such a manner that the respective motors are controlled to be matched with the can feeding speed of the can feeding device.

According to the printing apparatus of the invention, the ink supply unit is unitized, as described above. When the printing apparatus is stopped, the ink supply unit moves radially outward and is located at the standby position, and thus gaps are provided in both the periphery of the plate cylinder and the circumferentially adjacent ink supply units. Plate replacement or maintenance can be performed through the gaps. As a result, it is easy to perform plate replacement or maintenance, and thus it is easy to automate plate replacement. Furthermore, when the ink supply units are located at the operation positions, a gap may not be provided in a portion between the circumferentially adjacent ink supply units. As a result, the number of the ink supply units can be increased. In other words, the number of plate cylinders can be increased.

DETAILED DESCRIPTION OF THE INVENTION

Hereinafter, an embodiment of the invention will be described with reference to the accompanying drawings. In the following description, the vertical direction is parallel to the vertical direction in FIG. 1. Furthermore, in a front-rear direction, the front side of the paper sheet of FIG. 1 corresponds to the front side and the back side of the paper sheet corresponds to the rear side.

Figure 1:
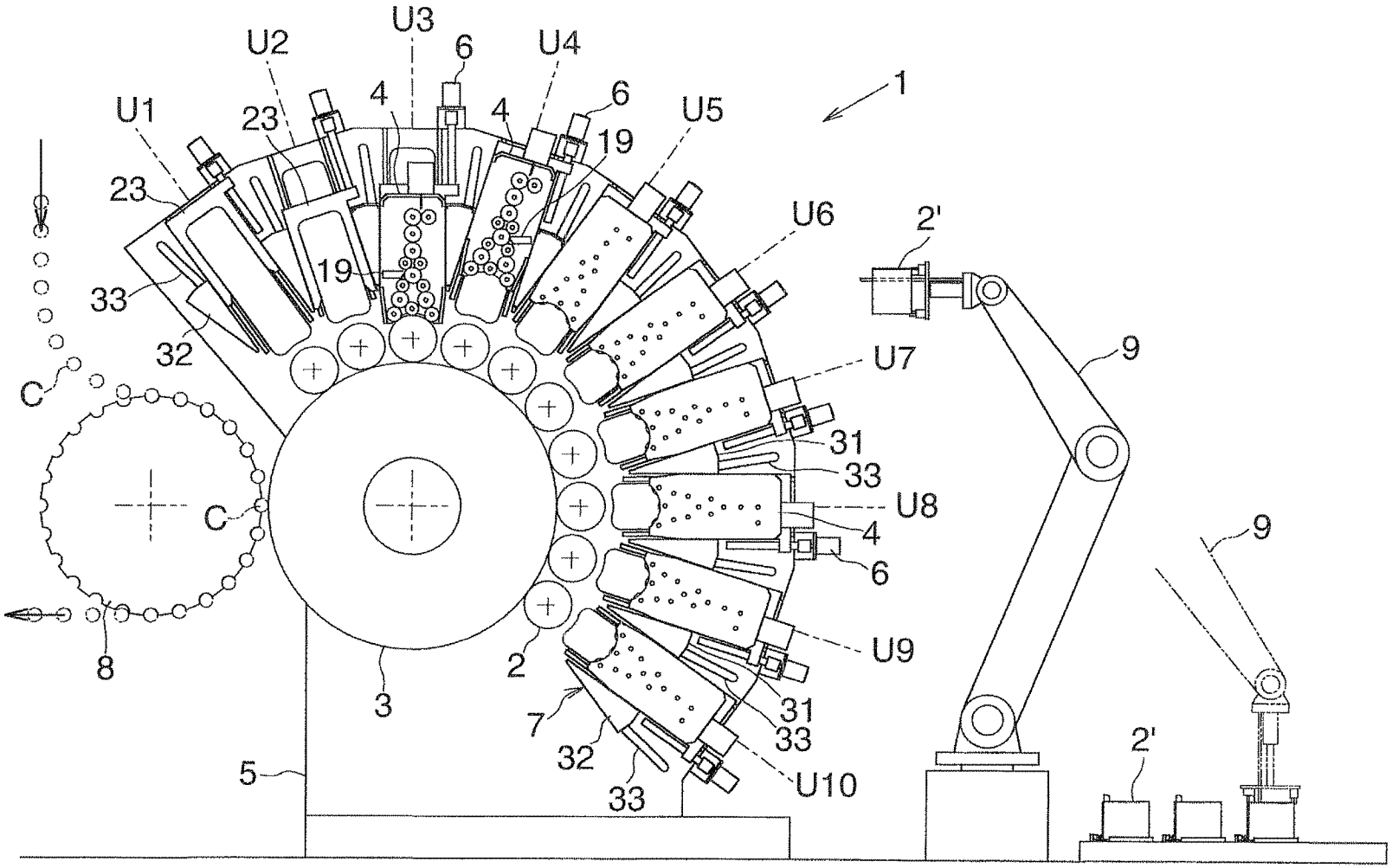
FIG. 1 is a front view illustrating a printing apparatus of an embodiment of the invention, in which the printing apparatus is partially not illustrated so as to clearly show a principal portion and both a state where an ink supply unit is located at an operation position and a state where an ink supply unit is located at a standby position are illustrated.
Figure 2:
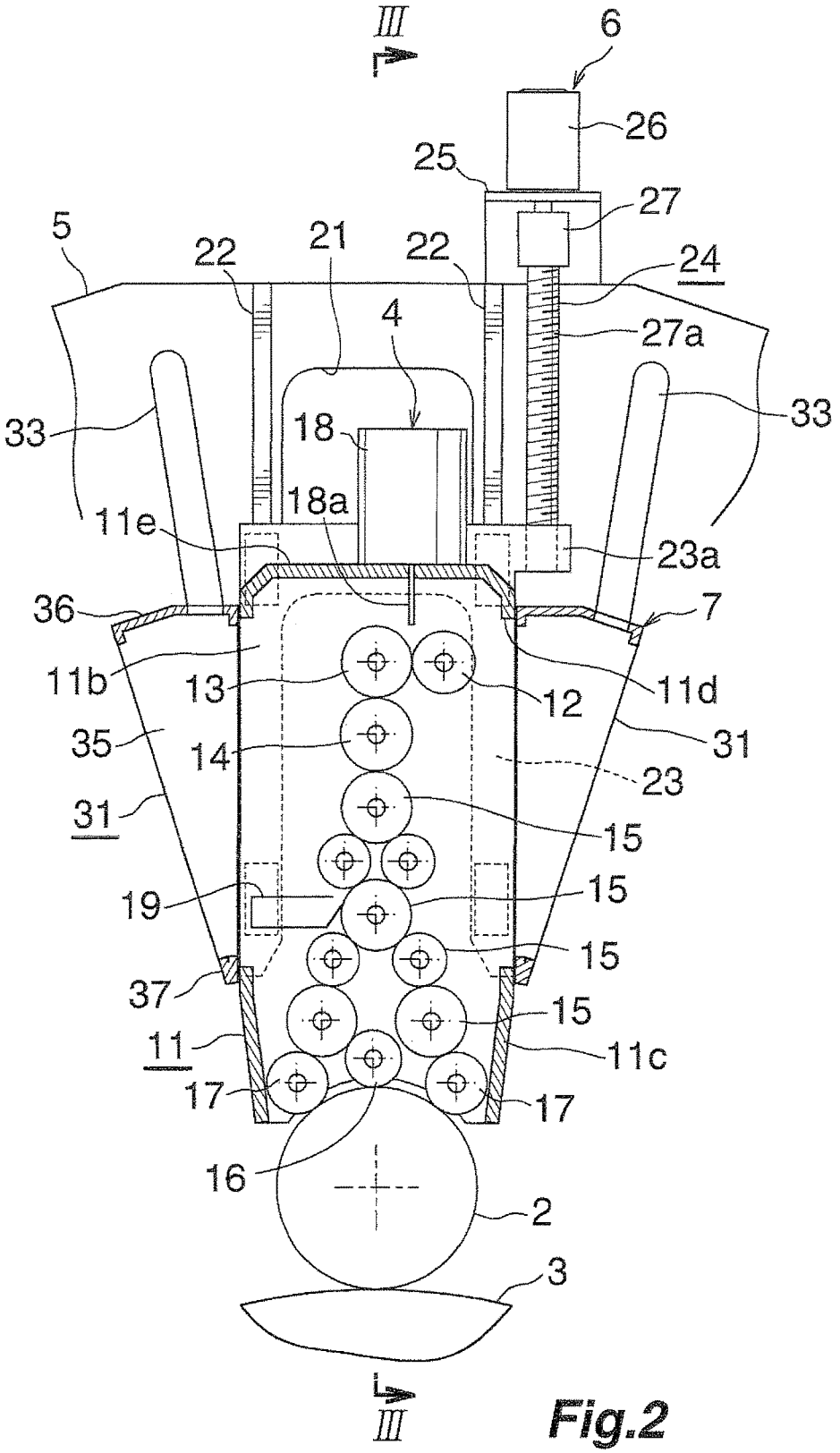
FIG. 2 is an enlarged view illustrating a principal portion in FIG. 1.
Figure 3:
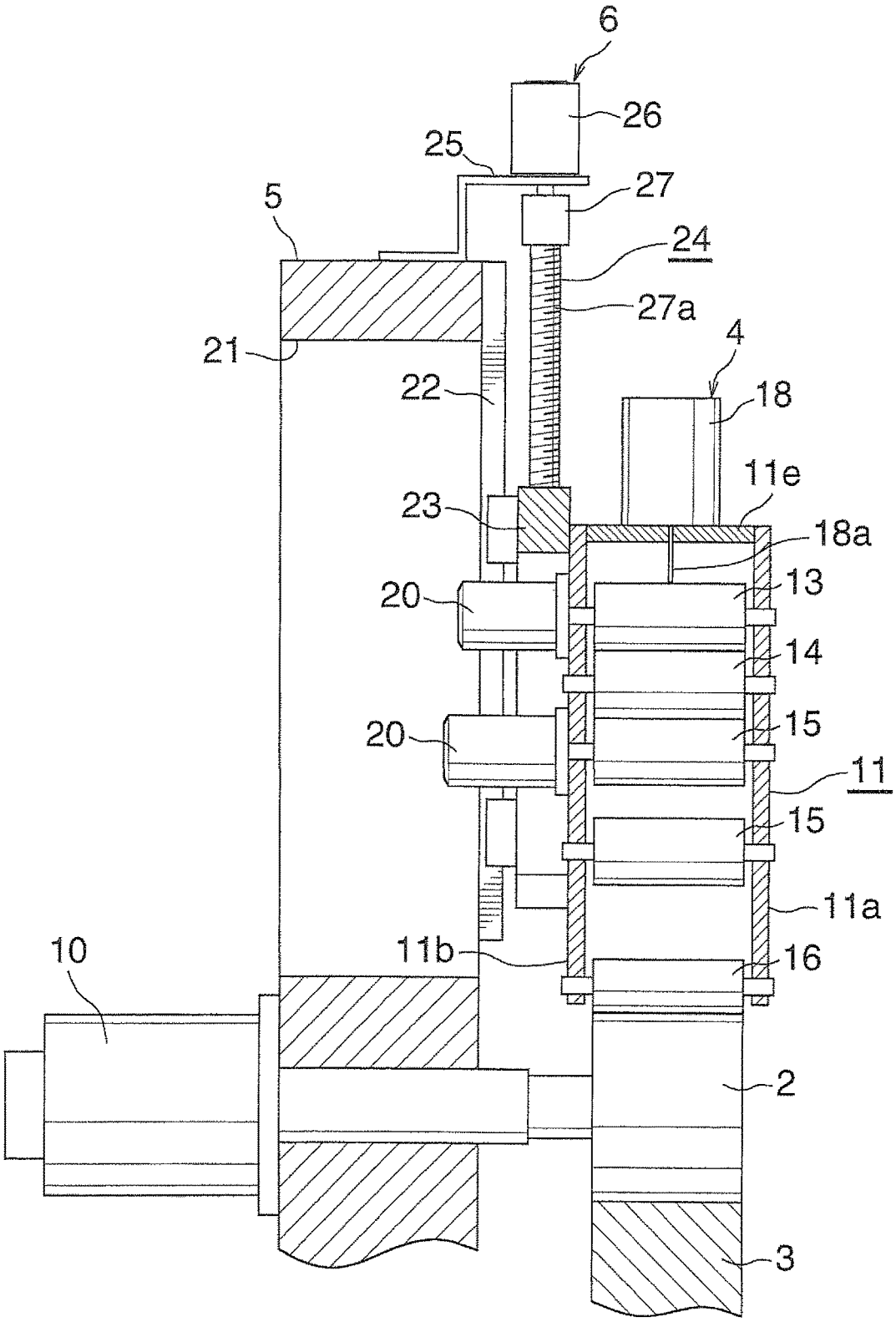
FIG. 3 is a cross-sectional view taken along line III-III in FIG. 2.
Figure 4:
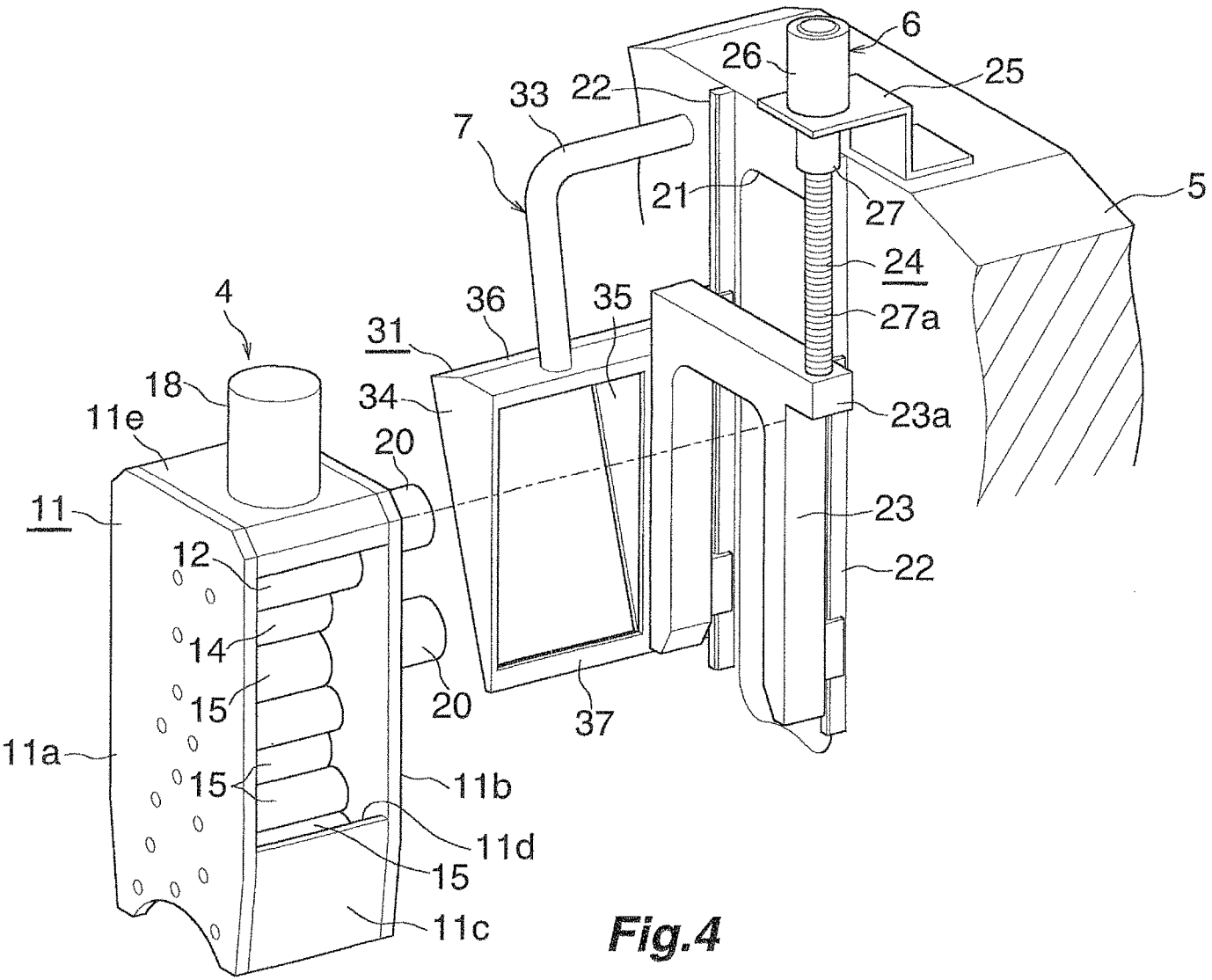
FIG. 4 is an enlarged exploded perspective view of a principal portion.

FIG. 1 illustrates the appearance of the entirety of an embodiment of a printing apparatus 1 having a plurality of ink supply units. FIGS. 2 to 4 illustrate enlarged views of one of the ink supply units of the printing apparatus 1.

In FIG. 1, the printing apparatus 1 performs printing on a can body (a body of a two-piece can) C having a cylindrical shape of which the top portion is opened. The printing apparatus 1 includes a plurality (ten, in FIG. 1) of plate cylinders 2, a blanket cylinder 3, a plurality of ink supply units 4, a machine frame 5, an ink supply unit moving device 6, a dust collector 7, a can feeding device 8, and a robot 9. The respective plate cylinders 2 include plates to perform printing of different colors. The blanket cylinder 3 performs printing on a can, in such a manner that ink is transmitted from each plate cylinder 2 to the blanket cylinder 3. The ink supply units 4 respectively supply ink to the plate cylinder 2. The machine frame 5 supports the plurality of plate cylinders 2, the blanket cylinder 3, and the plurality of ink supply units 4. The ink supply unit moving device 6 moves each ink supply unit 4 between an operation position and a standby position. The dust collector 7 sucks up mist generated in each ink supply unit 4. The can feeding device 8 continuously sends can bodies C to a position in which the respective can bodies C come into contact with the blanket cylinder 3. The robot 9 automatically performs replacement of each plate cylinder 2 with a stored plate cylinder 2'.

The plurality of plate cylinders 2 are arranged on the front-side surface of the machine frame 5, in a state where the centers of the plate cylinders 2 are located on the circumference of the blanket cylinder 3 and are spaced apart with gaps in the circumferential direction. Each plate cylinder 2 is driven by a motor 10, as illustrated in FIG. 3.

The ink supply unit 4 is disposed on an outer side of the plate cylinder 2 in a radial direction. The ink supply unit 4 can move between the operation position and the standby position. The ink supply unit 4 can supply ink to the plate cylinder 2, at the operation position. The standby position is a position located further to the radially outer side of the printing apparatus 1 than the operation position.

In total, ten plate cylinders 2 are provided. Accordingly, up to ten ink supply units 4 can be arranged.

The ink supply unit 4 is a unitized member having a casing 11 accommodating components, such as rollers. Each ink supply unit 4 includes, as components, an ink fountain roller 12, an ink feeding roller 13, and ink ducting roller 14, a plurality (eight, in FIG. 2) of ink distributing rollers 15, three ink applying rollers 16 and 17, an ink container 18, and an ink scraping device for cleaning 19, as illustrated enlarged in FIG. 2.

The three ink applying rollers 16 and 17 have a configuration in which a relatively small roller (corresponding to the ink applying roller 16) is interposed between a pair of relatively large rollers (corresponding to the ink applying rollers 17). The respective ink applying rollers 16 and 17 cannot move in a direction perpendicular to an axial direction. In other words, it is only possible for the respective ink applying rollers 16 and 17 to rotate.

The ink feeding roller 13 is disposed close to the ink fountain roller 12, and thus an ink flow path is formed in a portion between the ink fountain roller 12 and the ink feeding roller 13. The ink supply tube 18*a* of the ink container 18 is disposed facing the ink flow path. The ink ducting roller is disposed close to the ink feeding roller 13. Furthermore, one of the plurality of ink distributing rollers 15 is disposed close to the ink ducting roller 14. The ink ducting roller 14 is constituted of a plurality of narrow-width rollers divided in an axial direction. The narrow-width rollers are arranged in the axial direction with small gaps therebetween. The ink in the ink container 18 is supplied to a portion between the ink fountain roller 12 and the ink feeding roller 13. Subsequently, the ink ducting roller 14 adjusts the amount of ink and the ink passes through both the plurality of ink distributing rollers 15 and the plurality of ink applying rollers 16 and 17. Then, the ink is supplied to the plate of the plate cylinder 2.

The position of each narrow-width roller of the ink ducting roller 14 is switched between a position in which the narrow-width roller is separated from the ink distributing roller 15 and comes into contact with the ink feeding roller 13 and a position in which the narrow-width roller is separated from the ink feeding roller 13 and comes into contact with the ink distributing roller 15. Furthermore, periods at which the respective narrow-width rollers are in contact with the ink feeding roller 13 are separately controlled. As a result, the amount of ink supplied to the plate of the plate cylinder 2 can be appropriately maintained.

Motors 20 are connected to both a rotation shaft of the ink feeding roller 13 and a rotation shaft of the ink distributing roller 15 in contact with the ink ducting roller 14, as illustrated in FIG. 3. Rotation of the motor 20 is transmitted to some of the plurality of ink distributing rollers 15, through a belt (not illustrated).

Among the rollers 12, 13, 14, 15, 16, and 17 constituting the ink supply unit 4, the rollers 13, 14, 15, 16, and 17 are symmetrically arranged with respect to a central line extending in the radial direction, except for the ink fountain roller 12.

The ink scraping device for cleaning 19 is constituted of a nozzle for ejecting cleaning solution, a scraper for scraping remaining ink, a tank for storing the scraped ink, and the like. The ink scraping device for cleaning 19 is disposed in a horizontal direction. An air cylinder can cause the ink scraping device for cleaning 19 to be in contact with or separated from the ink distributing roller 15 facing the ink scraping device for cleaning 19. When printing is performed, the ink scraping device for cleaning 19 is at a position at which the ink scraping device for cleaning 19 is separated from the ink distributing roller 15. When cleaning is performed, the ink scraping device for cleaning 19 is moved to the ink distributing roller 15 side.

Among the ten ink supply units 4 (hereinafter, referred to as a first unit (U1) to a tenth unit (U10)) illustrated in FIG. 1, the first to third units U1, U2, and U3 have the ink scraping devices for cleaning 19 disposed on counter-clockwise sides, as illustrated in the third unit U3 (the third unit U3 is illustrated in FIG. 2). In contrast, the fourth to tenth units U4, U5, U6, U7, U8, U9, and U10 have the ink scraping devices for cleaning 19 disposed on clockwise sides, as illustrated in the fourth unit U4 in FIG. 1. When cleaning is performed, the rotating direction of the motor 20 of the ink distributing roller 15 having the ink scraping device for cleaning 19 provided therein is selected in accordance with the arrangement position of the ink scraping device for cleaning 19. Accordingly, limitation in the arrangement position of the ink scraping device for cleaning 19 is eliminated, and thus it is easy to arrange the ink supply units 4 in a state where the gap between the adjacent ink supply units 4 is reduced.

The casing 11 of the ink supply unit 4 has a substantially rectangular tubular shape. Both end portions of the rollers 12, 13, 14, 15, 16, and 17 are rotationally supported by both a front wall 11*a* and rear wall 11*b*. A lateral wall 11*c* is provided in a state where the lateral wall 11*c* connects the radially inner-side portion of the front wall 11*a* and the radially inner-side portion of the rear wall 11*b*. As a result, an opening 11*d* is provided in the casing 11 to open to the circumferential side. A top wall 11*e* is provided in the tip portion (in other words, in the radially outer side) of the casing 11. A bottom portion (in other words, the radially inner side) of the casing 11 is opened toward the radially inner side. The outer-circumferential edge portions of the three ink applying rollers 16 and 17 are exposed through the opening in the bottom portion.

The ink supply unit moving device 6 includes a pair of slide rails 22, a slider 23, and a driving device 24. The pair of slide rails 22 extends in the radial direction, along both edges of a through-hole 21 which is formed in the machine frame 5 to extend in the radial direction. The slider 23 is disposed on the pair of slide rails 22, in a state where the slider 23 can move in the radial direction. The slider 23 has an inverted-U shape, when viewed from the front. The driving device 24 is mounted, via a bracket 25, on the machine frame 5 and causes the slider 23 to move in the radial direction.

A ball screw feeding device 27 driven by a motor 26 is used as the driving device 24. A protrusion portion 23*a* is provided in the top portion of the slider 23, to protrude in the circumferential direction. A screw shaft 27*a* of the ball screw feeding device 27 is screwed into a penetrating-internal thread which is formed in the protrusion portion 23*a* and extends in the radial direction.

Although not illustrated, an appropriate linear feeding device, other than a ball screw feeding device, may be used as the driving device 24.

The rear wall 11*b* of the casing 11 is fixed to the slider 23 from the front, through a screw (not illustrated). Thus, the ink supply unit 4 moves along with slider 23, in the radial direction. When the ink supply unit 4 moves radially inward, the ink supply unit 4 is located at the operation position at which the three ink applying rollers 16 and 17 are in contact with the plate cylinder 2. In contrast, when the ink supply unit 4 moves radially outward, the ink supply unit 4 is located at the standby position at which a gap is formed in a portion between the radially inner-side end portion of the casing 11 of the ink supply unit 4 and the plate cylinder 2.

In the illustration of FIG. 1, the third unit U3 is located at the operation position and the fourth to tenth units U4 to U10 are located at the standby positions. Furthermore, in the illustration of both the first unit U1 and the second unit U2, the ink supply units 4 are not illustrated. In the illustration of the first unit U1, the slider 23 is located at the standby position. In the illustration of the second unit U2, the slider 23 is located at the operation position.

The dust collector 7 includes an intermediate sealing member 31, an end-portion sealing member 32, and a suction tube (sucking means) 33. The intermediate sealing member 31 seals a space between the adjacent ink supply units 4 in the operation positions. The end-portion sealing members 32 seal spaces on the circumferential outer-sides of the ink supply units 4 which are provided in both circumferential end sides and are located at the operation positions. The suction tube 33 sucks up mist in an internal sealed space connected with the respective sealing members 31 and 32.

The intermediate sealing member 31 is constituted of a front closing plate 34, a rear closing plate 35, a radially outer-side closing plate 36, and a radially inner-side closing plate 37. Accordingly, the intermediate sealing member 31 has a shape opened to both circumferential sides. One opening of the intermediate sealing member 31 communicates with the opening 11*d* of one of the adjacent ink supply units 4 in the operation positions. In addition, the other opening of the intermediate sealing member 31 communicates with the opening 11*d* of the other one of the adjacent ink supply units 4 in the operation positions. As a result, the space between the adjacent ink supply units 4 in the operation positions is sealed.

The end-portion sealing member 32 has a configuration in which one of two openings of the intermediate sealing member 31 is closed by an outer closing plate. Accordingly, the end-portion sealing member 32 has a shape opened to one side in the circumferential direction. The opening of the end-portion sealing member 32 communicates with the opening 11*d* of the ink supply unit 4 which is located on the circumferentially outermost side in the operation position. As a result, the space on the circumferentially outer side of the ink supply unit 4 which is located on the circumferentially outermost side in the operation position is sealed.

The dust collector 7 is fixed to the machine frame 5. The intermediate sealing members 31 are provided in the portion between the adjacent ink supply units 4 and the end-portion sealing members 32 are provided in the circumferential outer sides of the ink supply units 4 which are provided in both circumferential end sides. Accordingly, when the respective ink supply units 4 are located at the operation positions, a sealed space having a fan shape, when viewed from the front, is formed. Suction tubes 33 are arranged at predetermined intervals, with respect to the sealed space. The respective suction tubes 33 are subjected to suction, using pumps (not illustrated). Accordingly, mist can be sucked up in a state where the mist generated in printing is sealed in the sealed space. The mist passes through the rear side of the machine frame 5 and is discharged to the outside of a building. As a result, the mist can be prevented from being scattered.

According to the printing apparatus 1 described above, in a printing process, printing is performed in such a manner that the respective ink supply units 4 are located at the operation positions, and thus ink is supplied to the plate cylinders 2. The amounts of movement of the respective ink supply units 4 in the radial direction are separately controlled by the ball screw feeding devices 27 corresponding thereto. In addition, the fine adjustment of a pressing force of the ink applying rollers 16 and 17, relative to the plate cylinder 2, can be performed in such a manner that the amount of movement of the slider 23 by the ball screw feeding device 27 is adjusted.

In the printing apparatus of the related art, respective ink supply units are fixed at operation positions, and thus the ink supply units cannot move. However, in the case of the printing apparatus 1 described above, when printing is not performed, the respective ink supply units 4 are moved to the standby positions located further to the radially outer side of the printing apparatus 1 than the operation positions. Accordingly, gaps can be provided in both the periphery of the plate cylinder 2 and the portion between the adjacent ink supply units 4. Plate replacement or maintenance of the plate cylinder 2 or each ink supply unit 4 can be performed through the gaps. Furthermore, a large space is ensured in the periphery of the plate cylinder, and thus it is easy to perform plate replacement using the robot 9.

Accordingly, when the respective ink supply units 4 are located at the operation positions, it is not necessary to provide gaps for performing plate replacement or maintenance of the plate cylinder 2 or each ink supply unit 4. Thus, in this case, a significantly small gap is provided in the portion between the adjacent ink supply units 4. As a result, an increased number of both the plate cylinders 2 and the ink supply units 4 can be arranged.

In the above description, the plate cylinder 2 and the rollers 13 and 15 of the ink supply unit 4 are driven by the motors 10 and 20 and, further, the blanket cylinder 3 is also driven by a motor. Furthermore, an encoder (means for detecting speed) (not illustrated) for detecting the rotating speed (the feeding speed) of the can feeding device 8 is additionally provided as a motor control device, and thus the motors 10 and 20, including the motor for the blanket cylinder 3, are controlled so as to be matched with the can feeding speed of the can feeding device 8.

The specific configurations of the respective ink supply units 4 are not limited to those illustrated in the accompanying drawings. The arrangement positions of the ink fountain rollers 12 may be changed in accordance with the arrangement positions of the respective ink supply units 4 and the arrangement positions of the ink containers 18 of the respective ink supply units 4 may be separately changed.

What is claimed is:

1. A printing apparatus comprising:

a plurality of plate cylinders for printing different colors arranged in a circumferential direction at predetermined intervals in a state where the centers of the plate cylinders are located on the circumference of a circle whose center is located at the center of a blanket cylinder;

a plurality of ink supply units which respectively supply ink to the plate cylinders;

a machine frame which supports the plurality of plate cylinders and the plurality of ink supply units; and an ink supply unit moving device that moves the ink supply unit between an operation position and a standby position, the ink supply unit being in contact with a respective plate cylinder when at the operation position, and the ink supply unit being out of contact with the respective plate cylinder when at the standby position, wherein the ink supply unit is a unitized member having a casing accommodating components therein, wherein the ink supply unit corresponding to the plate cylinder is disposed on a radially outer side of the plate cylinder, wherein the ink supplying unit moving device moves the casing of the ink supply unit to move the ink supply unit between the operation position in which ink can be supplied to the plate cylinder and the standby position located further to an outer side in a radial direction of the blanket cylinder than the operation position, wherein, when the ink supply unit is located at the standby position, a first gap is provided between the ink supply unit and the respective plate cylinder and a second gap is provided between the ink supply unit and adjacent ink supply units so that maintenance can be performed on the ink supply unit or the respective plate cylinder, wherein, when the ink supply unit is located at the operation position, a significantly smaller gap than the second gap is provided between the ink supply unit and the adjacent ink supply units, wherein an opening is provided in the casing to open to the circumferential side, and an intermediate sealing member is provided between the adjacent ink supply units in the operation positions, wherein the intermediate sealing member is constituted of a front closing plate, a rear closing plate, a radially outer-side closing plate, and a radially inner-side closing plate, and the intermediate sealing member has a shape opened to both circumferential sides, and wherein a first opening of the intermediate sealing member communicates with the opening of the casing of a first adjacent ink supply unit in the operation position and a second opening of the intermediate sealing member communicates with the opening of the casing of a second adjacent ink supply unit in the operation position.

2. The printing apparatus according to claim 1, wherein the ink supply unit moving device includes a pair of slide rails extending in the radial direction of the blanket cylinder, a slider which is disposed on the pair of slide rails in a state where the slider can move in the radial direction of the blanket cylinder and is mounted on the casing of the ink supply unit, and a driving device which is mounted on the machine frame and moves the slider in the radial direction.

3. The printing apparatus according to claim 2, wherein the driving device is a ball screw feeding device driven by a motor, wherein a protrusion portion is provided in a portion of the slider to protrude in the circumferential direction, and wherein a screw shaft of the ball screw feeding device is screwed into a penetrating-internal thread that is formed in the protrusion portion and extends in the radial direction.

4. The printing apparatus according to claim 1, wherein ink scraping devices for cleaning are respectively provided in the ink supply units, wherein a plurality of rollers constituting the ink supply unit are symmetrically arranged with respect to a central line extending in the radial direction of the blanket cylinder, except for an ink fountain roller, and wherein the ink scraping devices for cleaning include the ink scraping device for cleaning disposed on a clockwise side of the ink supply unit and the ink scraping device for cleaning disposed on a counter-clockwise side of the ink supply unit.

5. The printing apparatus according to claim 1, wherein the printing apparatus is a printing apparatus for a can which performs printing on a can supplied by a can feeding device, wherein the printing apparatus includes a plurality of motors for driving a blanket cylinder, the plate cylinder, and the rollers of the ink supply unit, and a motor control device, and wherein the motor control device has speed detecting means for detecting the feeding speed of the can feeding device and controls the respective motors to be matched with the can feeding speed of the can feeding device.

6. The printing apparatus according to claim 1, wherein the ink supply unit includes, as the components, an ink feeding roller, an ink ducting roller, a plurality of ink distributing rollers, one or more ink applying rollers, an ink container, and an ink scraping device.

7. The printing apparatus according to claim 1, further comprising:

a dust collector, wherein the dust collector includes a plurality of intermediate sealing members, each of which seals a space between the adjacent ink supply units in the operation positions, end-portion sealing members which seal spaces on circumferential outer-sides of the ink supply units in both circumferential ends, and sucking means which is connected to at least one of the plurality of intermediate sealing members and the end-portion sealing members and sucks up mist in an internal space.

* * * * *